US011662185B2

(12) United States Patent
Yang et al.

(10) Patent No.: US 11,662,185 B2
(45) Date of Patent: May 30, 2023

(54) AMORPHOUS SHAPED CHARGE COMPONENT AND MANUFACTURE

(71) Applicant: Schlumberger Technology Corporation, Sugar Land, TX (US)

(72) Inventors: Wenbo Yang, Sugar Land, TX (US); Moises Enrique Smart, Houston, TX (US); Jason Mai, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/155,346

(22) Filed: Oct. 9, 2018

(65) Prior Publication Data

US 2019/0041173 A1 Feb. 7, 2019

Related U.S. Application Data

(62) Division of application No. 14/229,400, filed on Mar. 28, 2014, now abandoned.

(60) Provisional application No. 61/808,385, filed on Apr. 4, 2013, provisional application No. 61/806,785, filed on Mar. 29, 2013.

(51) Int. Cl.

| | |
|---|---|
| ***F42B 1/032*** | (2006.01) |
| ***F42B 1/036*** | (2006.01) |
| ***E21B 43/117*** | (2006.01) |
| ***F42B 1/028*** | (2006.01) |

(52) U.S. Cl.

CPC ..... *F42B 1/032* (2013.01); *E21B 43/117* (2013.01); *F42B 1/028* (2013.01); *F42B 1/036* (2013.01)

(58) Field of Classification Search

CPC ..... F42B 1/032; F42B 1/036; E21B 43/117
USPC ..... 175/4.6; 102/306
See application file for complete search history.

(56) References Cited

U.S. PATENT DOCUMENTS

| | | | | |
|---|---|---|---|---|
| 3,135,205 | A | 6/1964 | Fritz | |
| 3,276,369 | A | 10/1966 | Bell | |
| 3,675,575 | A | 7/1972 | Bailey et al. | |
| 3,750,582 | A * | 8/1973 | Kintish | F42B 12/18 102/476 |

(Continued)

FOREIGN PATENT DOCUMENTS

| | | |
|---|---|---|
| WO | 0042289 A1 | 7/2000 |
| WO | 0107860 A2 | 2/2001 |

(Continued)

OTHER PUBLICATIONS

Advisory Action received in the related U.S. Appl. No. 14/229,400 dated Jul. 10, 2019 (6 pages).

(Continued)

*Primary Examiner* — Taras P Bemko
(74) *Attorney, Agent, or Firm* — Jeffrey D. Frantz

(57) ABSTRACT

An amorphous-based material component may be incorporated into a liner for a shaped charge used in perforating a wellbore casing. Other components of the shaped charge and/or perforating gun that accommodates the shaped charge may be of amorphous-based materials. Further, the liner and other components of the shaped charge may be manufactured by way of three dimensional printing. Indeed, a multi-material three dimensional print application may be utilized to form shaped charge components simultaneously along with an entire perforating gun system.

19 Claims, 6 Drawing Sheets

(56) References Cited

U.S. PATENT DOCUMENTS

| | | | | |
|---|---|---|---|---|
| 4,004,515 | A | 1/1977 | Mallory et al. | |
| 4,253,523 | A | 3/1981 | Ibsen | |
| 4,498,367 | A * | 2/1985 | Skolnick | F42B 1/032 102/321.1 |
| 4,766,813 | A * | 8/1988 | Winter | F42B 1/032 102/307 |
| 5,505,135 | A | 4/1996 | Fritz et al. | |
| 5,859,383 | A | 1/1999 | Davison et al. | |
| 6,238,595 | B1 | 5/2001 | Brooks et al. | |
| 6,296,044 | B1 | 10/2001 | Brooks et al. | |
| 6,305,289 | B1 | 10/2001 | Mayseless et al. | |
| 6,386,109 | B1 | 5/2002 | Brooks et al. | |
| 6,386,296 | B1 | 5/2002 | Kothari et al. | |
| 6,397,752 | B1 | 6/2002 | Yang et al. | |
| 6,446,558 | B1 | 9/2002 | Peker et al. | |
| 6,453,817 | B1 | 9/2002 | Markel et al. | |
| 6,520,258 | B1 | 2/2003 | Yang et al. | |
| 6,554,081 | B1 | 4/2003 | Brooks et al. | |
| 6,557,650 | B2 | 5/2003 | Fayard et al. | |
| 6,732,798 | B2 | 5/2004 | Johnson et al. | |
| 6,874,579 | B2 | 4/2005 | Johnson et al. | |
| 6,896,059 | B2 | 5/2005 | Brooks et al. | |
| 6,966,377 | B2 | 11/2005 | Johnson et al. | |
| 7,000,699 | B2 | 2/2006 | Yang et al. | |
| 7,159,657 | B2 | 1/2007 | Ratanasirigulchia et al. | |
| 7,409,992 | B2 | 8/2008 | Zazovsky et al. | |
| 7,600,476 | B1 | 10/2009 | Baker et al. | |
| 7,661,367 | B2 | 2/2010 | Yang et al. | |
| 7,775,279 | B2 | 8/2010 | Marya et al. | |
| 8,156,871 | B2 | 4/2012 | Behrmann et al. | |
| 8,166,882 | B2 | 5/2012 | Yang | |
| 8,342,094 | B2 | 1/2013 | Marya et al. | |
| 8,347,963 | B2 | 1/2013 | Johnson et al. | |
| 8,584,772 | B2 | 11/2013 | Yang et al. | |
| 8,677,903 | B2 | 3/2014 | Marya et al. | |
| 8,887,609 | B1 * | 11/2014 | Cherry | F42B 1/028 86/50 |
| 2002/0189483 | A1 * | 12/2002 | Parrott | E21B 43/117 102/312 |
| 2005/0211467 | A1 | 9/2005 | Ratanasirigulchia et al. | |
| 2006/0075888 | A1 | 4/2006 | Yang et al. | |
| 2006/0266551 | A1 | 11/2006 | Yang et al. | |
| 2007/0107616 | A1 * | 5/2007 | Grove | F42B 1/032 102/306 |
| 2007/0158109 | A1 | 7/2007 | Zazovsky et al. | |
| 2008/0075618 | A1 * | 3/2008 | Martin | B22F 3/1055 419/6 |
| 2009/0078144 | A1 | 3/2009 | Behrmann et al. | |
| 2009/0151949 | A1 | 6/2009 | Marya et al. | |
| 2009/0235836 | A1 * | 9/2009 | Pratt | F42B 1/032 102/306 |
| 2010/0044044 | A1 | 2/2010 | Johnson et al. | |
| 2010/0132578 | A1 | 6/2010 | Yang et al. | |
| 2010/0147587 | A1 | 6/2010 | Henderson et al. | |
| 2010/0275800 | A1 | 11/2010 | Stawovy | |
| 2010/0319562 | A1 | 12/2010 | Yang | |
| 2011/0048587 | A1 | 3/2011 | Vecchio et al. | |
| 2011/0056362 | A1 | 3/2011 | Yang et al. | |
| 2011/0094406 | A1 | 4/2011 | Marya et al. | |
| 2011/0155013 | A1 | 6/2011 | Boyer et al. | |
| 2013/0056269 | A1 | 3/2013 | Xu | |
| 2013/0087061 | A1 | 4/2013 | Marya et al. | |
| 2013/0118805 | A1 | 5/2013 | Moody-Stuart et al. | |
| 2013/0320598 | A1 * | 12/2013 | Atkins | B21K 5/04 264/497 |
| 2014/0151046 | A1 | 6/2014 | Marya et al. | |
| 2014/0291022 | A1 | 10/2014 | Yang et al. | |
| 2016/0169639 | A1 * | 6/2016 | Smart | F42B 1/032 102/306 |

FOREIGN PATENT DOCUMENTS

| | | | | |
|---|---|---|---|---|
| WO | 0198624 | A1 | 12/2001 | |
| WO | 2010151422 | A1 | 12/2010 | |
| WO | 2011031817 | A2 | 3/2011 | |
| WO | 2011031817 | A3 | 3/2011 | |
| WO | 2011049678 | A2 | 4/2011 | |
| WO | 2011049678 | A3 | 4/2011 | |
| WO | WO-2012071449 | A2 * | 5/2012 | E21B 41/00 |
| WO | 2013191821 | A1 | 12/2013 | |

OTHER PUBLICATIONS

Office Action Received in U.S. Appl. No. 14/229,400 dated Apr. 22, 2020, 18 pages.

Office Action Received in U.S. Appl. No. 14/229,400 dated Aug. 10, 2020, 6 pages.

Office Action Received in U.S. Appl. No. 14/229,400 dated Sep. 18, 2020, 17 pages.

* cited by examiner

AMORPHOUS SHAPED CHARGE COMPONENT AND MANUFACTURE

PRIORITY CLAIM/CROSS REFERENCE TO RELATED APPLICATION(S)

This Patent Document is a divisional of U.S. Non-Provisional patent application Ser. No. 14/229,400, entitled "Amorphous Shaped Charge Component And Manufacture", which claims priority under 35 U.S.C. § 119 to U.S. Provisional App. Ser. No. 61/806,785, entitled "Materials for Oilfield Shaped Charges and Guns", filed on Mar. 29, 2013, and to U.S. Provisional App. Ser. No. 61/808,385, entitled "Perforating Tools and Components", filed on Apr. 4, 2013. Each of these applications are incorporated herein by reference in its entirety for all purposes.

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. Specifically, shaped charges housed within the steel gun may be detonated to form perforations or tunnels into the surrounding formation, ultimately enhancing recovery therefrom.

The profile, depth and other characteristics of the perforations are dependent upon a variety of factors in addition to the material structure through which each perforation penetrates. That is, the jet formed by the detonation of a given shaped charge may pierce steel casing, cement and a variety of different types of rock that make up the surrounding formation. However, characteristics of different components of the shaped charge itself may determine the characteristics of the jet and ultimately the depth, profile and overall effectiveness of each given perforation as described below.

Among other components, a shaped charge generally includes a case, explosive pellet material and a liner. Thus, detonation of the explosive within the case may be utilized to direct the liner away from the gun and toward the well wall as a means by which to form the noted jet. Therefore, understandably, the characteristics of the jet are largely dependent upon the behavior of the liner and other shaped charge components upon detonation. For example, a solid copper or zinc liner may be utilized to generate a jet of considerable stretch with a head or tip that travels at 5-10 times the rate of speed as compared to the speed at the tail. Depending on the casing thickness, formation type and other such well-dependent characteristics, this type of liner is generally of notable effectiveness in terms of achieving substantial depth of penetration.

Unfortunately, a solid metal liner of the general type described above faces limitations in terms of the actual effectiveness of the penetration. For example, as described above, the perforation is a tunnel into the formation from which hydrocarbons may be extracted. However, a solid metal liner is prone to penetrate the formation in a manner that often leaves a slug of material lodged within the perforation. Thus, even where the perforation is of notable depth, it is often largely obstructed. Further, as the solid liner material begins to stretch and break up, it begins to tumble resulting in a loss of coherence and penetrating character.

In order to avoid such issues with solid liners, a crystalline powder liner may instead be utilized. For example, a crystalline base material may be mixed with a binding agent such as copper or lead and pressed into a liner component for assembly into a shaped charge. Thus, upon detonation of the shaped charge, a perforating jet will emerge from a crystalline powder material that readily disintegrates as opposed to emerging from a solid liner that is prone to leave behind a slug within the perforation.

Unfortunately, while the crystalline powder liner is not as prone to leave behind an occlusive slug, it is also not as prone to develop a jet of notable stretch or effectiveness in terms of perforating depth. That is, given the near immediate disintegration of the liner, its stretch, density distribution and other factors that might enhance depth are limited. Ultimately, this leaves the perforating gun operator with the undesirable choice between utilizing a shaped charge that may result in a perforation that is compromised by a slug versus one that may result in a perforation that is limited in terms of penetration depth.

SUMMARY

An embodiment of the present disclosure provides a shaped charge for use with a perforating gun in forming a perforation into a formation at a well wall with a jet. The shaped charge comprises a case, an explosive pellet accommodated by the case, and a liner of an amorphous-based material tailored to enhance the jet in forming the perforation. The liner is formed by a three dimensional print manufacturing application.

Another embodiment of the present disclosure provides a method comprising the steps of (a) deploying a perforating gun into a well to a target location adjacent a formation, and (b) detonating a shaped charge within a body of the gun at the location to generate a jet of enhanced character for tunneling a perforation into the formation. The shaped charge comprises a case accommodating an explosive pellet adjacent an amorphous-based material liner to support the enhanced character. In the method, one of the liner, the case, the shaped charge, the body of the perforating gun, or the loading tube of the perforating gun is formed as part of a three dimensional print manufacturing application.

Another embodiment of the present disclosure provides a multi-material three dimensional print method of manufacturing a shaped charge. The method comprises printing a case of a first material, printing an explosive pellet of a second material, and printing a liner of a third material. The printing of the case, explosive and liner takes place as part of a three dimensional print manufacturing application.

DETAILED DESCRIPTION

Embodiments are described with reference to certain downhole perforating applications in vertical cased well environments. In particular, wireline deployed applications utilizing a shaped charge assembly system are detailed. However, other forms of deployment and well architectures may take advantage of the shaped charge assembly system as detailed herein. For example, multi-zonal wells may benefit from such a system during stimulation operations. Regardless, so long as shaped charge components take advantage of amorphous materials, such as an amorphous liner, significant benefit may be realized in the perforating application.

Figure 1:
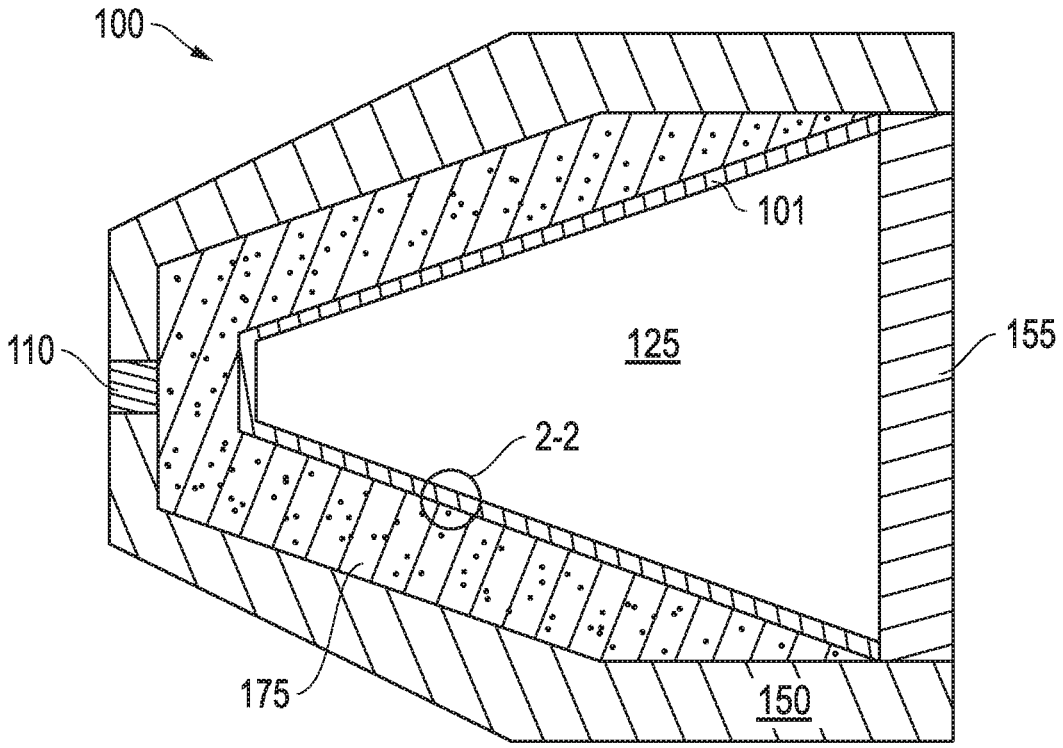
FIG. 1 is a side cross sectional view of an embodiment of a shaped charge incorporating a liner of amorphous material.

Referring now to FIG. 1, a side cross sectional view of an embodiment of a shaped charge 100 is shown. The charge 100 utilizes a liner 101, at least a portion of which is primarily and/or exclusively of an amorphous material. That is, the entire liner 101 may be of such a material or have a segment or portion that is of such a material. Regardless, the amorphous material portion may be referred to herein as an "amorphous-based" material. For example, as described in further detail below, the entire liner 101, or a predetermined portion thereof, may be of a silicon, metallic or other suitable glass with a variety of different fillers or additives incorporated therein. Regardless, as also detailed further below, a liner 101 of such an amorphous-based material may be utilized to enhance the stretch of a jet 400 during perforating in a well 380 such that substantial depth of a perforation 425 may be attained (see also FIGS. 3 and 4A). Further, the amorphous nature of the liner 101 may substantially remove the possibility of liner material forming a slug that might undesirably block an end 427 of the perforation 425 (see FIG. 4A).

Continuing with reference to FIG. 1, in addition to the noted liner 101, the shaped charge 100 includes a case 150 that accommodates an explosive pellet material 175. The explosive pellet 175 is located between the liner 101 and the case 150 with the case 150 being made up of a robust material such as steel or zinc. Thus, once a fuse 110 is triggered to ignite the pellet 175, the material of the liner 101 may breach the void space 125 of the charge 100 and extend beyond a seal 155 of the case 150 to form a jet (e.g. 400 of FIG. 4A). In theory, the longer the jet 400 or the greater the stretch (S), the deeper the penetration or perforation 425 (again see FIG. 4A). As detailed further below, such characteristics may be achieved through use of a liner 101 that is of an amorphous-based material.

The case 150 may be formed by conventional machining such as computer, numeric code or forging. The amorphous-based material liner 101 may also be separately machined from a solid bar. Additionally, the liner 101 may be formed by stamping, pressing or other suitable techniques. Regardless, the separately formed case 150 and liner 101 may be assembled together with the pellet 175 sandwiched therebetween and the case seal 155 placed thereover. However, in an embodiment detailed further below with reference to FIG. 5, any one of the case 150, pellet 175 or liner 101 components may be formed via emerging three dimensional print techniques. Indeed, all three components may be simultaneously formed as part of the same three dimensional printing application. Once more, in addition to the use of an amorphous-based material for the liner 101, an amorphous-based material may also be utilized in forming the case 150. In this embodiment, the comparatively higher density and impedance available from such a material structure may be taken advantage of to focus explosive energy into the forming jet during charge detonation as described further below.

Figure 2A:
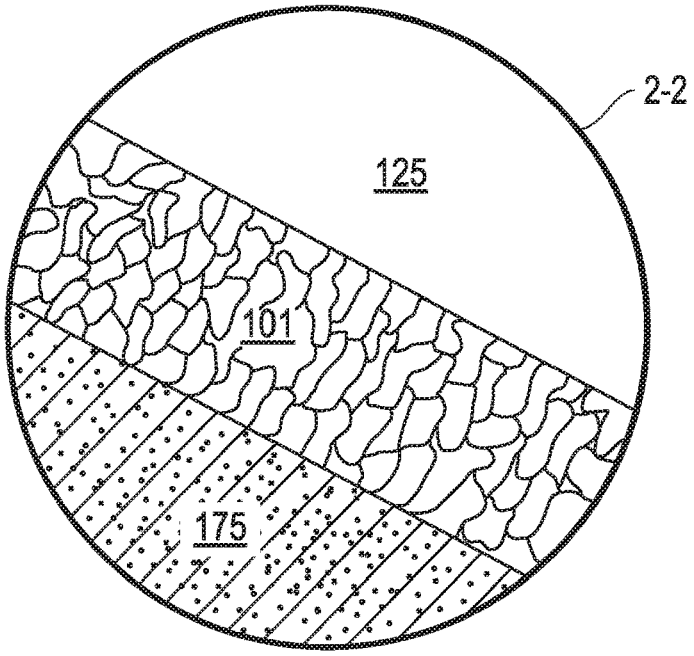
FIG. 2A is an enlarged view of the amorphous material liner and surrounding architecture taken from 2-2 of FIG. 1, highlighting the amorphous material structure.
Figure 2B:
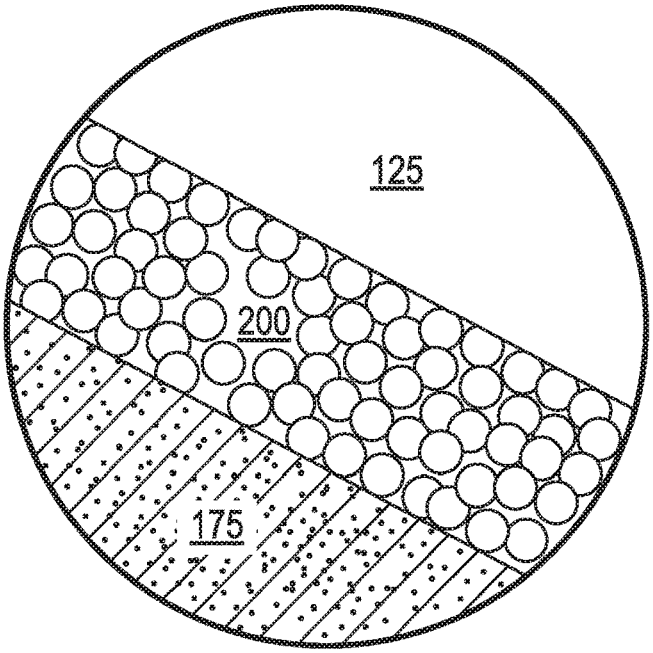
FIG. 2B (Prior Art)
FIG. 2B is an enlarged view of a conventional crystalline pressed powder liner and surrounding architecture, highlighting the crystalline material structure.

Referring now to FIG. 2A, an enlarged view of the amorphous material liner 101 and surrounding architecture taken from 2-2 of FIG. 1 are shown. The representative view of the amorphous liner 101 of FIG. 2A is shown in contrast to the conventional prior art crystalline powder liner 200 and surrounding structure of FIG. 2B. For example, the prior art crystalline liner 200 of FIG. 2B is of a repeating uniformity as a powder that is represented as a multitude of spheres in a pressed liner form. Thus, upon triggering of the underlying pellet 175, the near immediate dispersal of powder from the pressed liner form may be understood. While adept at avoiding the formation of a slug and other large debris issues, the near immediate dispersal may adversely affect the ability of the emerging jet to display significant stretch.

With particular focus on FIG. 2A, the structure of the amorphous-based liner 101 may avoid the near immediate disintegration and dispersal of the prior art liner 200 of FIG. 2B. In this respect, the amorphous-based liner 101 may be more like a conventional solid liner. Yet, unlike a solid liner, the amorphous-based material is not a monolithic solid, but rather, is comprised of a suitable glass-like structure as depicted. Thus, with added reference to FIG. 4A, a notable stretch (S) may be achieved in jet formation, while at the same time, the liner material remains prone to substantial breakup. As a result, the formation of larger slug and debris pieces may be avoided so as to prevent blocking of perforations 425 created by the triggering of the pellet 175.

Figure 4A:
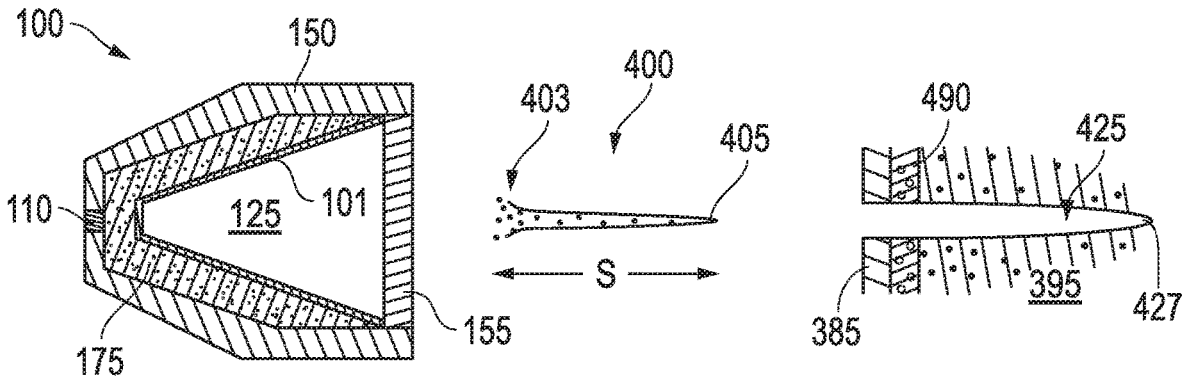
FIG. 4A is a side cross-sectional view of the shaped charge of FIG. 1 forming a deep penetrating jet directed at a wall of the well of FIG. 3.

Continuing with reference to FIG. 2A, with added reference to FIG. 4A, the amorphous-based liner 101 may utilize traditional liner materials such as tungsten, copper, lead, other metals, oxides and mixtures thereof, but in a glass form as opposed to a solid or powder form. Additionally, additives and fillers may be incorporated into the amorphous-based material. For example, binders or higher density additives, perhaps in crystalline powder form, may be incorporated to help tailor or further extend the stretch (S) of the jet 400 for sake of achieving a deeper perforation 425. Indeed, a liner 101 of suitably high density amorphous material such as a tungsten glass may be of a less variable porosity and density as compared to a conventional crystalline powder liner (e.g. 200 of FIG. 2B). Thus, a more continuous, cohesively stretching jet 400 may be realized for sake of the indicated deeper perforation 425 in absence of any notable formation of blocking debris.

The amorphous-based material liner 101 of FIG. 2A may be formed in a variety of manners. For example, glass particles, including any additives or fillers, may be pressed like a more conventional powder liner. Similarly, such a matrix in the form of a glass bar may be machined into a liner akin to machining of a conventional solid metal liner. However, the amorphous-based material also lends itself to casting, injection molding and other manufacturing techniques. Indeed, as described further below, the liner 101 may even be three dimensionally printed.

Figure 3:
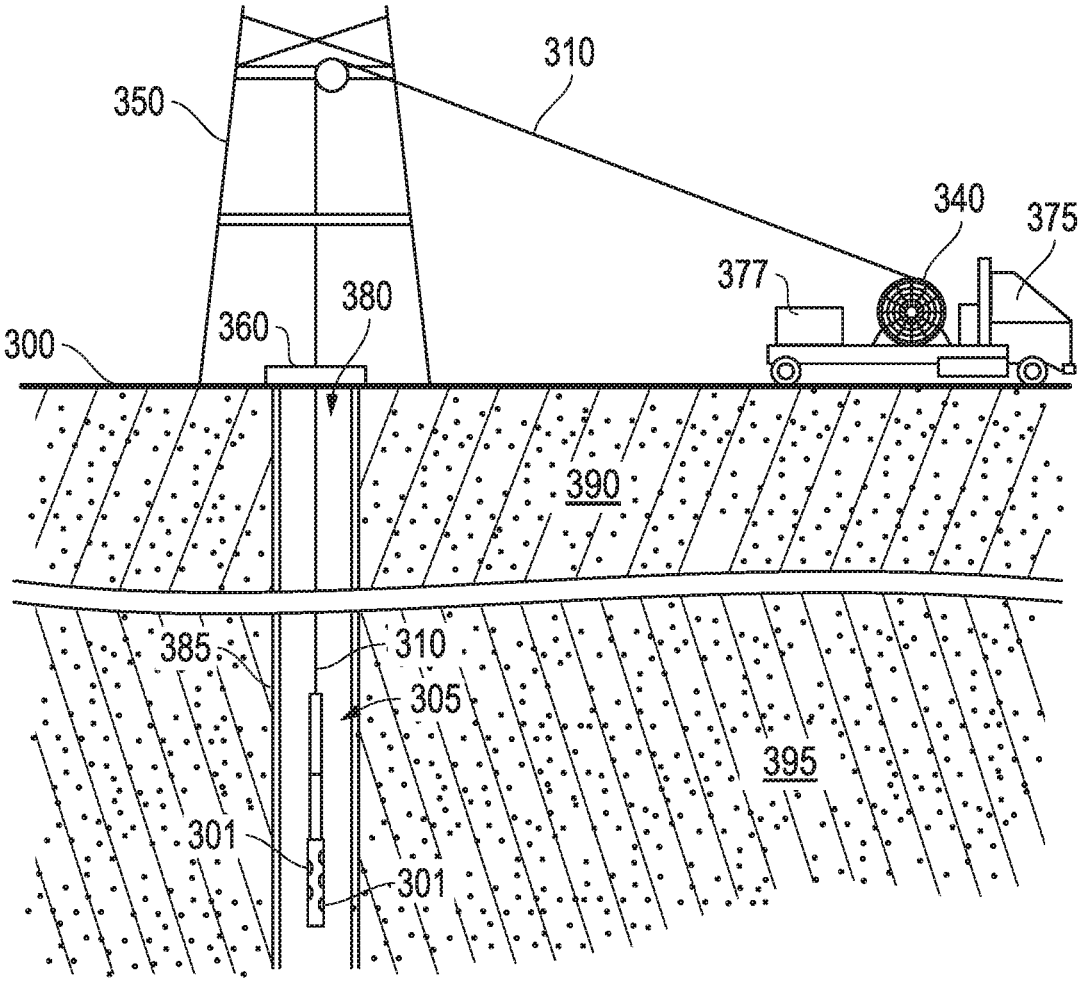
FIG. 3 is an overview of an oilfield with a well having a gun disposed therein for forming a perforation with the shaped charge of FIG. 1.

Referring now to FIG. 3, an overview of an oilfield 300 is shown with a well 380 having a gun 305 located therein. The gun 305 is a perforating gun that is loaded with shaped charges 100 such as the one depicted in FIG. 1. Specifically, the gun 305 is outfitted with ports 301 that are aligned with shaped charges that have been loaded into the gun 305. Thus, perforating of the adjacent casing 385 and formation 395 may take place.

The gun 305 of FIG. 3 may be manufactured through conventional machining with thread and seal bores at either end. A separate laser cut steel tube may directly accommodate the shaped charges with the tube loaded into the gun 305 as a manner by which all of the charges may be simultaneously loaded.

Continuing with reference to FIG. 3, the gun 305 is deployed into the well 380 via wireline 310 and traversing various formation layers 390, 395 before reaching the target location shown. In the depicted embodiment, the gun 305 is deployed by the wireline 310 that is unwound from a reel 340 at a wireline truck 375. Thus, a rig 350 may support lowering of the gun 305 past a wellhead 360 and into the well 380 for the noted perforating application. A control unit 377 located at the truck 375 may be utilized for directing the gun 305 to the target location in this manner. Once the perforating application is complete, the wireline 310, gun 305 and any other associated tools may be removed from the well 380 to enhance flow from the formed perforations 425 and well 380 (see FIG. 4A). Of course, a variety of other modes of delivery and retrieval may be utilized.

In order to keep the amount of debris formed during perforating at a minimum, the gun 305 may be constructed of an amorphous-based material with reactive agents incorporated therein. Thus, the gun 305 may be configured to disintegrate upon perforating with follow-on exothermal, oxidation or other tailored reaction taking place to break up the resultant debris into non-occlusive particle sizes. In fact, in one embodiment, such a disintegrating gun is formed via a three dimensional print application as described further below.

Figure 4B:
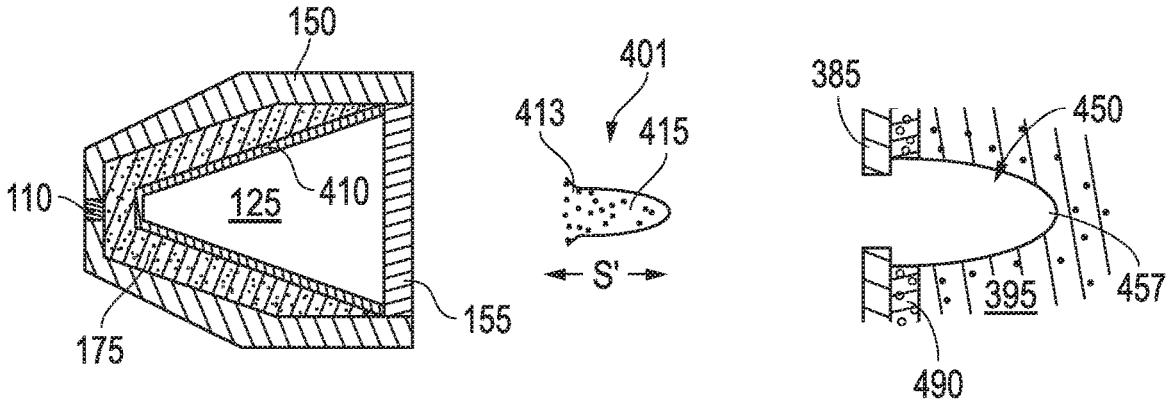
FIG. 4B is a side cross-sectional view of an alternate shaped charge forming a wide jet directed at the wall of the well of FIG. 3.
Figure 4C:
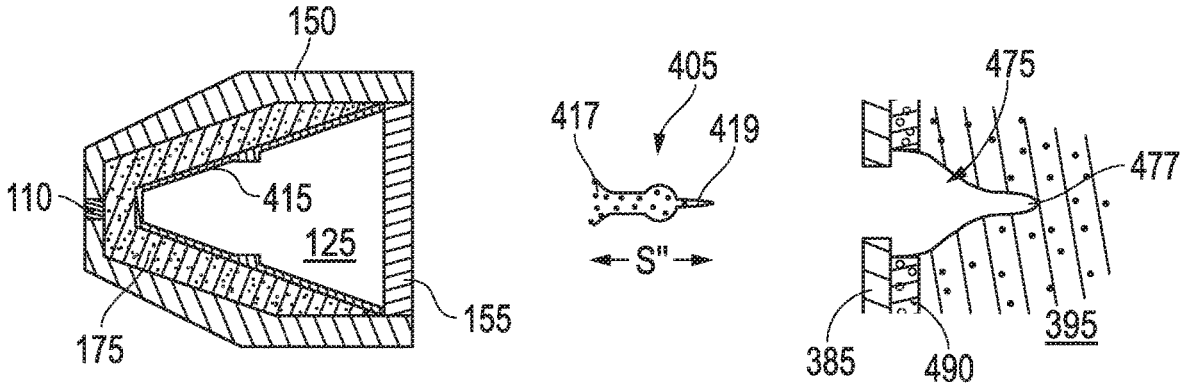
FIG. 4C is a side cross-sectional view of another embodiment of a shaped charge forming a tailored morphology jet directed at the wall of the well of FIG. 3.

Referring now to FIGS. 4A-4C, with added reference to FIG. 3, side cross-sectional views of a shaped charge 100, such as that of FIG. 1, are shown revealing jet formation upon firing. The charges 100 may have a case 150 of steel, zinc or even amorphous material with a liner most likely of amorphous material. Specifically, FIG. 4A depicts the shaped charge 100 of FIG. 1 utilizing an amorphous material liner 101 to form a deep penetrating jet 400 directed at the wall of the well 380. Alternatively, the charge 100 may utilize a liner 410 of a larger profile to form a wide jet 401 as shown in FIG. 4B. Indeed, the liner 415, jet 405 and resultant perforation 475 may all be of a tailored morphology as shown in FIG. 4C.

Regardless, the performance of each jet 400, 401, 405 may be enhanced by the inclusion of amorphous material within the shaped charge 100, particularly the liner 101, 410, 415, as described above. Thus, a slug-free terminal end 427, 457, 477 of a perforation 425, 450, 475 may be formed with sufficient penetration through casing 385, underlying cement 490 and into the formation 395 adjacent the well 380. In one embodiment, the liner 101, 410 and/or 415 may include reactive materials such as titanium to promote a reaction. Thus, the environment of the well and/or perforations 425, 450, 475 may remain effectively debris-free. In fact, in one embodiment, the amorphous materials may include reactive agents to allow for a lower initiation pressure during follow-on fracturing applications. In such embodiments, the reactive material may remain protected by amorphous or other surrounding materials but become exposed for reactivity following detonation. Such reactivity may even be utilized to actively reduce or "clean-out" some level of debris within perforations 425, 450, 475.

High density powders such as tungsten may also be incorporated into the liner 101, 410, 415 to enhance jet density. Additionally, the material of the case 150 may be tailored to match that of the liner 101, 410, 415.

With specific reference to FIG. 4A, upon firing of the shaped charge 100, the liner 101 exits the seal 155 and a jet 400 takes shape which is directed at the well wall. The amorphous material of the jet 400 is of a given stretch (S) as measured from head 405 to tail 403. The stretch (S) of the jet 400 may be enhanced by the use of the amorphous material of the liner 101 to provide a deeper penetration to the perforation 425. This enhanced stretch (S) may be commensurate with a significant velocity gradient from head 405 to tail 403. For example, material at the head 405 of the jet 400 may travel at 5 to 10 times the rate of speed as compared to material at the tail 403. More specifically, in one embodiment, material at the head 405 of the jet 400 may travel at over 7 km/sec. whereas material at the tail 403 travels at less than about 1 km/sec.

With specific reference to FIG. 4B, amorphous material of the liner 410 may also be utilized to form a wide jet 401. The jet 401 may again be of notable stretch (S') from head 415 to tail 413 with a commensurate velocity gradient as indicated above. Yet at the same time, the higher profile liner 410 of amorphous material may be utilized in a manner that allows for construction of a big hole charge for a wider perforation 450. However, as noted above, in contrast to solid liner based charges, use of an amorphous material in construction of the liner 410 is less prone to leaving behind a slug at the terminal end 457 of the perforation 450 that might interfere with hydrocarbon uptake.

Referring now to FIG. 4C a side cross-sectional view of another embodiment of a shaped charge is shown in which the liner 415 is of a uniquely tailored morphology. Thus, the resultant jet 405 and ultimately the corresponding perforation 475 may also be of a tailored morphology. Again, a substantial velocity gradient may be present between material at the head 419 and that at the tail 417 of the jet 405 along with a significant stretch (S"). Thus, sufficient penetration may be attained. Further, as detailed below, the component that is this particular liner 415 may benefit from manufacture by way of three dimensional printing. That is, due to small, tight specifications on component of such unique morphology may be more efficiently produced by way of printing techniques. Indeed, as detailed regarding FIG. 5 below, all charge components or even an entire gun system may be constructed from such printing techniques.

Figure 5:
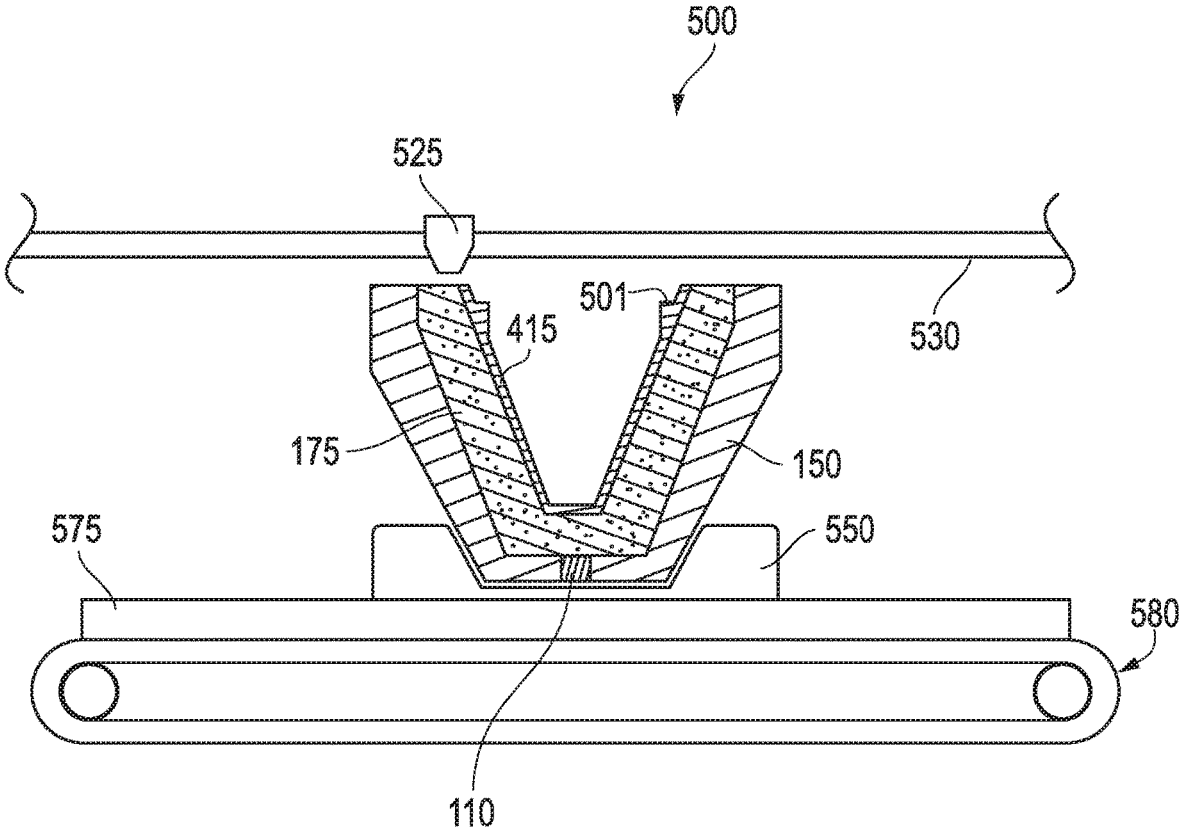
FIG. 5 is a side cross-sectional view of the shaped charge of FIG. 4C being formed during a three dimensional print manufacturing application.

Referring now to FIG. 5, a side cross-sectional view of the shaped charge of FIG. 4C is shown as it is being formed. Specifically, a multi-material three dimensional print manufacturing application 500 is being utilized to form the charge. However, in other embodiments individual single material components 150, 175, 415 may be formed one by one. Regardless, as noted above, three dimensional printing may be particularly beneficial where tight specifications on small features are involved. For example, see the heel 501 of the tailored liner 415 that is being produced. However, as a matter of process efficiency and avoiding time consuming steps involving subsequent component assembly, the entire charge may be simultaneously manufactured via three dimensional print techniques as depicted in FIG. 5.

Continuing with reference to FIG. 5, additive manufacturing, or three dimensional printing as referenced above, involves sequential layering of materials to manufacture a product. In the case of a shaped charge as shown, a support 530 suspends a deposition tool 525 at an appropriate and ascendable height over the forming charge. A carrier 550 at a table 575 therebelow may be moved via a conveyance 580 so as to allow the charge to take shape layer by layer during the printing process.

In addition to rapidly providing a charge or complete gun system, such three dimensional printing may allow a degree of specialized precision to components such as the liner 415, thereby optimizing performance. For example, in the case of the liner 415, tailoring the material gradient is rendered practical in addition to the morphology. In one embodiment, the liner 415 is of greater density, lesser porosity, or other characteristic at one end (e.g. at the skirt). Similarly, reactive materials, wave shape features, or other performance features may be precisely located at desired portions of the liner 415 due to the accuracy of the print technology.

Similar benefit may also be provided to the case 150 and/or explosive pellet 175. For example, the case 150 may be of a controlled porosity with post explosive debris characteristics in mind. The case 150 may even be of a multi-point initiation with tunnels at its base. By the same token, density, porosity and other characteristics of the pellet 175 may be precisely provided layer by layer such that the explosive output and resultant jet performance is maximized. This may even include providing selectively integrated non-explosive materials.

In one embodiment, the loading tube, gun and entire gun system may be three dimensionally printed as described above. Thus, specialized materials such as fast corrosives or cavities may be layered into these parts to reduce weight without substantial effect on performance. Indeed, the entire system may be constructed of materials such as reactives and fast corrosives that are configured to disintegrate or "disappear" upon detonation. Thus, little or no debris may be left downhole upon perforating.

Figure 6:
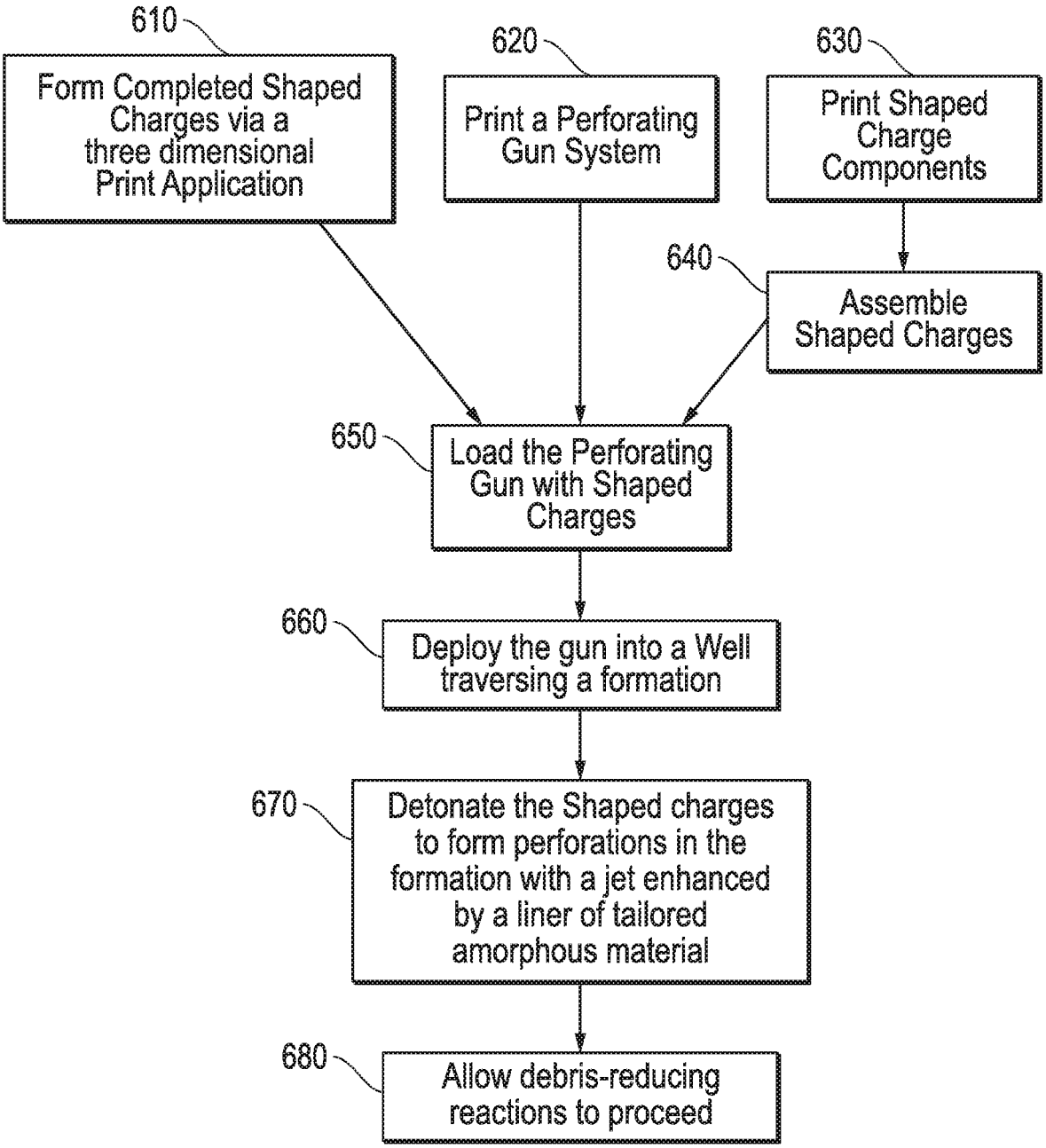
FIG. 6 is a flow-chart summarizing an embodiment of forming and utilizing shaped charges incorporating amorphous materials.

Referring now to FIG. 6, a flow-chart is shown summarizing an embodiment of forming and utilizing shaped charges incorporating amorphous materials. As indicated above, a multi-material three dimensional print application may be used to form a shaped charge as noted at 610. Indeed, an entire gun system may also be manufactured in this manner (620). This may include printing of the gun followed by loading with component assembled shaped charges as noted or the whole system, both gun and entire charges, may all be simultaneously printed as part of a single print application. Alternatively, as indicated at 630 and 640, component assembled shaped charges may be separately printed or manufactured for loading into a separately provided gun.

As noted above, with completed shaped charges in hand, the gun may be loaded as indicated at 650 and lowered into the well for a perforating application (see 660). As detailed hereinabove, benefits of utilizing amorphous materials, particularly those of the liner may be realized. Specifically, as indicated at 670, detonation of shaped charges may form perforations from a jet of characteristics enhanced by the utilization of a liner of tailored amorphous materials. In fact, as indicated at 680, debris-reducing reactions relative the gun, shaped charge components or even perforation clean-out may follow the perforating as a manner of maximizing follow-on hydrocarbon recovery.

Embodiments described hereinabove include a shaped charge that may be tailored of amorphous materials to substantially avoid the formation of a liner material slug that may become wedged within a perforation tunnel during the perforating. Thus, the effectiveness of the perforation for hydrocarbon uptake is not substantially hindered by such an occlusive or blocking type of material. By the same token, embodiments of the shaped charge may also be tailored to ensure the formation of an effective jet upon firing of the shaped charge.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

The invention claimed is:

1. A shaped charge for use with a perforating gun in forming a perforation into a formation at a well wall with a jet, the shaped charge comprising:

a case;

an explosive pellet accommodated by the case; and a liner comprising an amorphous-based metal material in glass form and one or more reactive materials that are exposed from within the amorphous-based metal material for reactivity following detonation of the shaped charge, the liner tailored to enhance the jet in forming the perforation, wherein the one or more reactive materials comprises titanium, wherein the liner has a shape feature, and wherein the shaped charge is configured such that the stretch of the jet runs between material at a head of the jet and material at a tail of the jet, and the jet has a velocity gradient with the head travelling greater than five times the speed of the tail.

2. The shaped charge of claim 1, wherein the jet is substantially slug-free relative the perforation formed thereby.

3. The shaped charge of claim 1, wherein the case includes a material that is one of steel, zinc, an amorphous-based material and a porous material.

4. The shaped charge of claim 1, wherein the case is of a material character selected to substantially match a material character of the liner in one of impedance, density and sound speed.

5. The shaped charge of claim 1, wherein the perforating gun is of a material that is one of a corrosive and an amorphous-based material.

6. The shaped charge of claim 1, wherein the shape feature is a heel.

7. The shaped charge of claim 1, wherein the liner is formed using a three-dimensional printer.

8. The shaped charge of claim 7, wherein each of the case, the explosive pellet, and the liner are formed using the same three dimensional printer.

9. A liner for incorporation into a shaped charge to form a perforation into a formation at a well wall with a jet, at least a portion of the liner comprising a shape feature, an amorphous-based metal material in glass form, and one or more reactive materials that are exposed from within the amorphous-based metal material for reactivity following detonation of the shaped charge, wherein at least the portion of the liner is tailored to enhance a stretch of the jet to provide a velocity gradient of greater than 5 and remain substantially slug-free relative the perforation, and wherein the one or more reactive materials comprise titanium.

10. The liner of claim 9, further comprising an additive of the amorphous-based metal material to tailor a characteristic of the jet, the additive selected from a group consisting of a binder, a density enhancer, a crystalline powder, and a reactive material agent.

11. The liner of claim 10, wherein the crystalline powder is tungsten.

12. A method, comprising:

deploying a perforating gun into a well to a target location adjacent a formation; and detonating a shaped charge within a body of the gun at the location to generate a jet of enhanced character having a velocity gradient greater than 5 for tunneling a perforation into the formation, the shaped charge comprising a case accommodating an explosive pellet adjacent to a liner comprising an amorphous-based metal material in glass form and one or more reactive materials that are exposed from within the amorphous-based metal material for reactivity following detonation of the shaped charge, the liner supporting the enhanced character, wherein the one or more reactive materials comprises titanium, and wherein the liner includes a shape feature.

13. The method of claim 12, wherein the enhanced character is one of a substantially slug-free character of the jet and an enhanced stretch of the jet.

14. The method of claim 12, further comprising running a reaction to break up material of one of the body of the gun, the case, and the liner into non-occlusive particle sizes following the detonating.

15. The method of claim 14, wherein the reaction is one of an exothermal reaction, an oxidation reaction, and a reaction cleaning out debris in the perforation.

16. The method of claim 14, wherein the running of the reaction comprises exposing the one or more reactive materials of the liner, or one or more additional reactive materials of one of the body of the gun and the case, or both, upon the detonating.

17. The method of claim 12, wherein the liner is of a tailored morphology.

18. The method of claim 12, wherein the three dimensionally formed component is of a tailored material gradient.

19. The method of claim 18, wherein the material gradient is tailored with respect to one of density, porosity, cavities, corrosives, reactive material and selectively integrated non-explosive material.

* * * * *